US012807288B2

(12) United States Patent
Chen et al.

(10) Patent No.: US 12,807,288 B2
(45) Date of Patent: Nov. 24, 2026

(54) BIOMIMETIC FISH DEVICE

(71) Applicant: Pioneer Material Precision Tech Co., Ltd., New Taipei City (TW)

(72) Inventors: Hsin-Chih Chen, New Taipei City (TW); Kuo-Hua Wu, New Taipei City (TW); Chih-Sheng Chen, New Taipei City (TW); Ching-Hung Liu, New Taipei City (TW); Wei-Yu Huang, New Taipei City (TW); Li-Yuan Yeh, New Taipei City (TW); Chang-Qi Zhang, New Taipei City (TW); Chih-Wei Shen, New Taipei City (TW); Guan-Hao Pan, New Taipei City (TW); Ching-Shu Lai, New Taipei (TW)

(73) Assignee: PIONEER MATERIAL PRECISION TECH CO., LTD., New Taipei City (TW)

( * ) Notice: Subject to any disclaimer, the term of this patent is extended or adjusted under 35 U.S.C. 154(b) by 357 days.

(21) Appl. No.: 18/611,578

(22) Filed: Mar. 20, 2024

(65) Prior Publication Data

US 2025/0236373 A1 Jul. 24, 2025

(30) Foreign Application Priority Data

Jan. 19, 2024 (TW) ..... 113102204

(51) Int. Cl.
*B63G 8/00* (2006.01)
*B63G 8/08* (2006.01)

(52) U.S. Cl.
CPC ..... *B63G 8/001* (2013.01); *B63G 8/08* (2013.01); *B63G 2008/002* (2013.01)

(58) Field of Classification Search
CPC ..... B63G 2008/002; B63G 8/08
See application file for complete search history.

(56) References Cited

U.S. PATENT DOCUMENTS

2021/0276678 A1* 9/2021 Yao ..... B63G 8/001
2024/0383592 A1* 11/2024 Li ..... B63H 1/36

FOREIGN PATENT DOCUMENTS

CN 114132466 A 3/2022
CN 114750914 A * 7/2022 ..... B63G 8/18
(Continued)

OTHER PUBLICATIONS

Search Report appended to an Office Action, which was issued to Taiwanese counterpart application No. 113102204 by the TIPO on Aug. 5, 2024, with an English translation thereof (2 pages).

*Primary Examiner* — Richard G Davis
(74) *Attorney, Agent, or Firm* — HSML P.C.

(57) ABSTRACT

A biomimetic fish device includes a fish-shaped shell unit having a plurality of shell members arranged adjacent to each other in a front-rear direction, and a plurality of rotating mechanisms each disposed within two adjacent shell members. Each rotating mechanism includes a motor module and a rotating member respectively mounted within front and rear shell members. The rotating member is pivotably connected with the motor module about an axis in an up-down direction. The motor modules are controlled and operated individually to rotate the corresponding rotating members so as to drive rotation of the shell members relative to each other. The fish-shaped shell unit can be bent with a plurality of smaller bending sections so as to imitate fish caudal fin locomotion.

8 Claims, 19 Drawing Sheets

(56) References Cited

FOREIGN PATENT DOCUMENTS

| | | | | |
|---|---|---|---|---|
| CN | 219857579 U | * | 10/2023 | |
| CN | 117284457 A | * | 12/2023 | ..... B63C 11/52 |

* cited by examiner

BIOMIMETIC FISH DEVICE

CROSS-REFERENCE TO RELATED APPLICATION

This application claims priority to Taiwanese Patent Application No. 113102204, filed on Jan. 19, 2024, and incorporated by reference herein in its entirety.

FIELD

The disclosure relates to a biomimetic underwater robot, and more particularly to a biomimetic fish device.

BACKGROUND

With the advance of technology, biomimetic devices are required to have better motion simulation. For example, a biomimetic fish device is expected to imitate a live fish's movements such as body caudal fin (BCF) swimming or locomotion, ascending, descending and obstacle avoidance maneuvers underwater. Thus, there is a trend in conventional biomimetic fish device development to make biomimetic fish device swim more naturally.

SUMMARY

Therefore, an object of the disclosure is to provide a biomimetic fish device that offers superior simulation of live fish.

According to the disclosure, the biomimetic fish device is movable forwardly in an underwater environment, and includes a fish-shaped shell unit and a plurality of rotating mechanisms. The fish-shaped shell unit includes a plurality of shell members which are arranged adjacent to each other in a front-rear direction. Each rotating mechanism is disposed within two adjacent ones of the shell members. Each rotating mechanism includes a first motor module which is mounted within a front one of the two adjacent shell members, and a first rotating member which is mounted to a rear one of the two adjacent shell members and which is pivotably connected with the first motor module about a first axis in an up-down direction. The first motor modules are controlled and operated individually to rotate the corresponding first rotating members about the first axis by a predetermined angle so as to drive rotation of the rear shell member relative to the front shell member.

With the rotating mechanisms operated to bring respectively the corresponding rear one of the shell members into reciprocating left and right turnings relative to the corresponding front one of the shell members, the fish-shaped shell unit can bend with a plurality of smaller bending sections so as to imitate body caudal fin (BCF) locomotion in an underwater environment.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
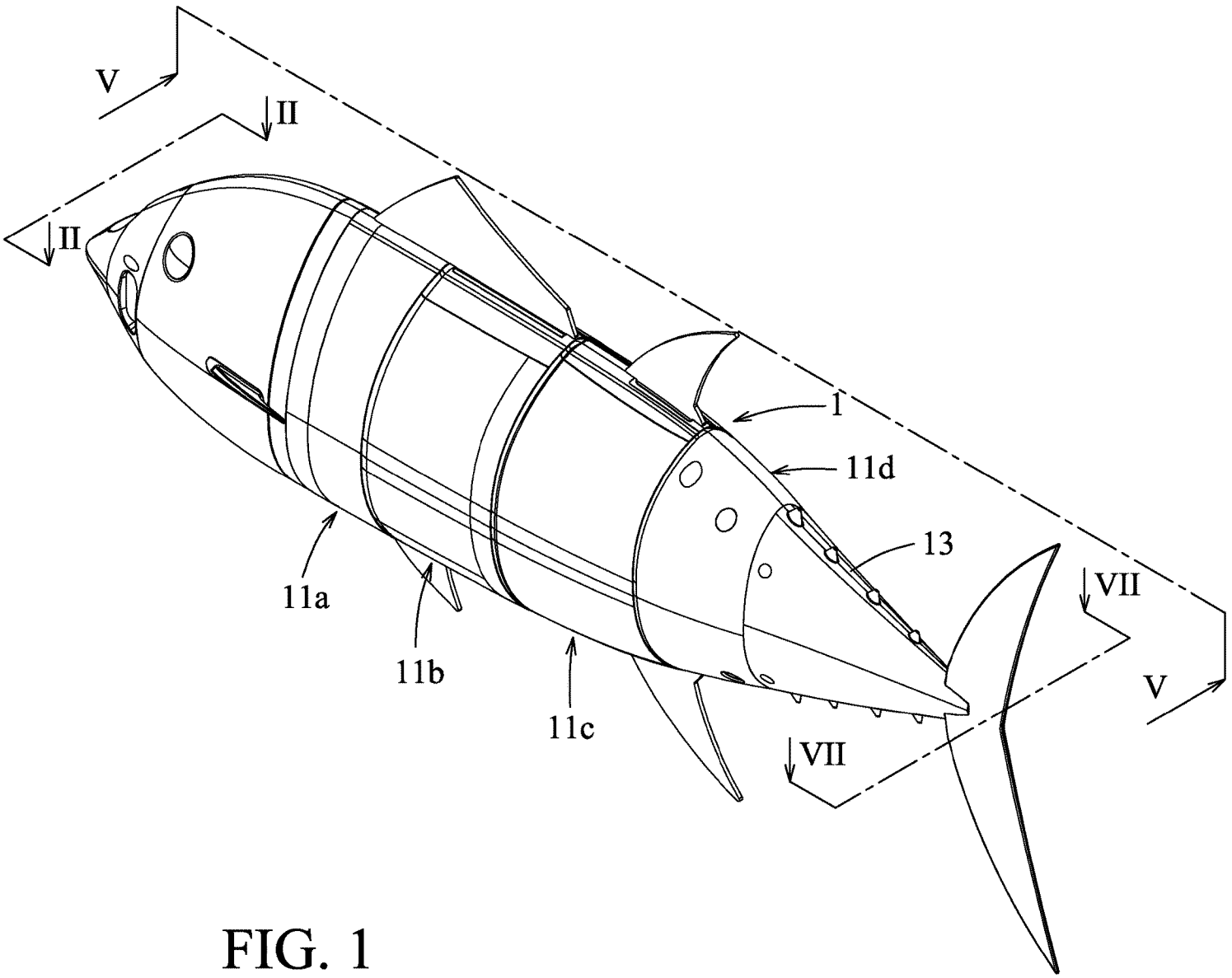
FIG. 1 is a perspective view illustrating an embodiment of a biomimetic fish device according to the disclosure in an initial state.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
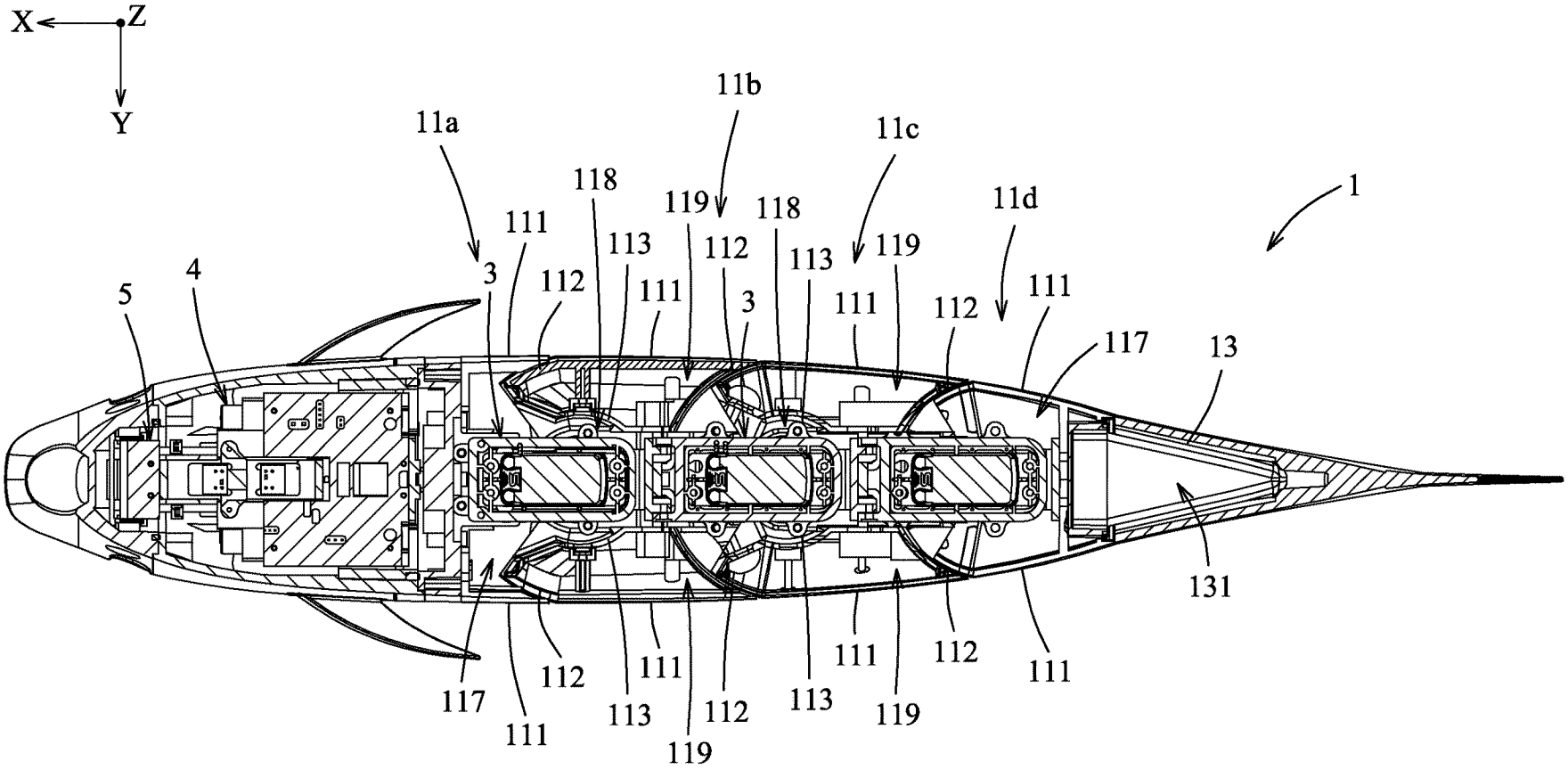
FIG. 2 is a sectional view taken along line II-II of FIG. 1.

Referring to FIGS. 1 and 2, an embodiment of a biomimetic fish device according to the disclosure is movable forwardly in an underwater environment (not shown), and includes a fish-shaped shell unit 1, a control module 2 (see FIG. 4), a plurality of rotating mechanisms 3, a gravity transferring mechanism 4 and a sensor module 5.

With reference to FIG. 1, the fish-shaped shell unit 1 has a fish profile such as a blackfin tuna, and is formed with fins, eyes and a mouth etc. The shell unit 1 includes a plurality of shell members (11*a*, 11*b*, 11*c*, 11*d*) which are arranged adjacent to each other in a front-rear direction (X), and a fish tail shell 13 which is disposed on the rearmost shell member (11*d*). Two adjacent ones of the shell members (11*a*, 11*b*, 11*c*, 11*d*) are rotatable relative to each other by means of one of the rotating mechanisms 3 so as to make the shell unit 1 imitate fish body caudal fin (BCF) swimming. In this embodiment, the number of the shell members is four, but may be two, four or more than four as required. The greater the number of the shell members, the less the stepwise difference will be between the shell members (11*a*, 11*b*, 11*c*, 11*d*) when the shell unit 1 swims so as to make it more mimetic. In the following description, the shell unit 1 includes a foremost shell member (11*a*) having a fish head shaped portion, a first middle shell member (11*b*) having a fish body part profile, a second middle shell member (11*c*) having a fish body part profile, and the rearmost shell member (11*d*) having a fish body part profile and followed by the fish tail shell 13 having a fish caudal peduncle profile.

Figure 3:
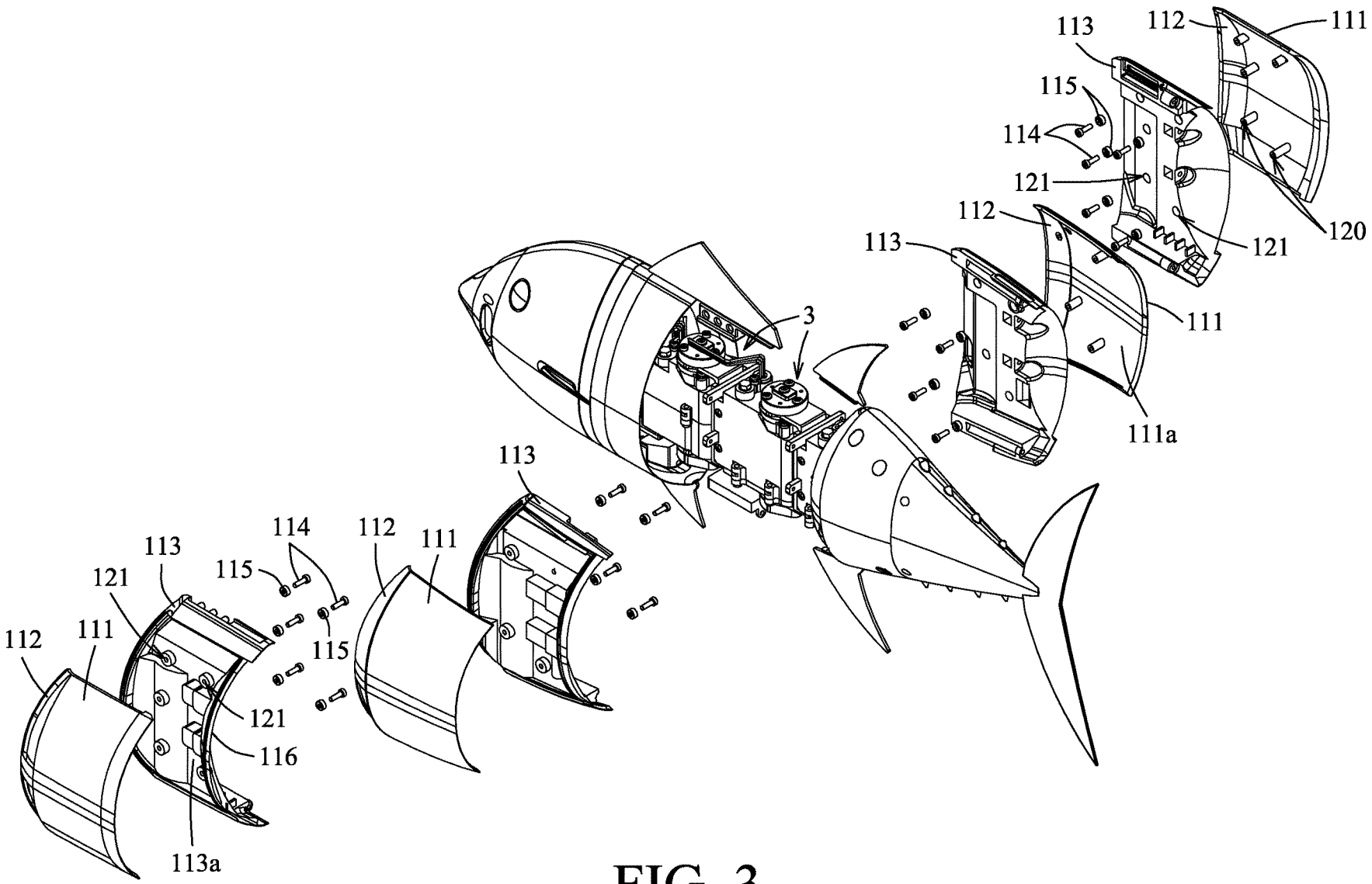
FIG. 3 is an exploded perspective view of the embodiment.
Figure 11:
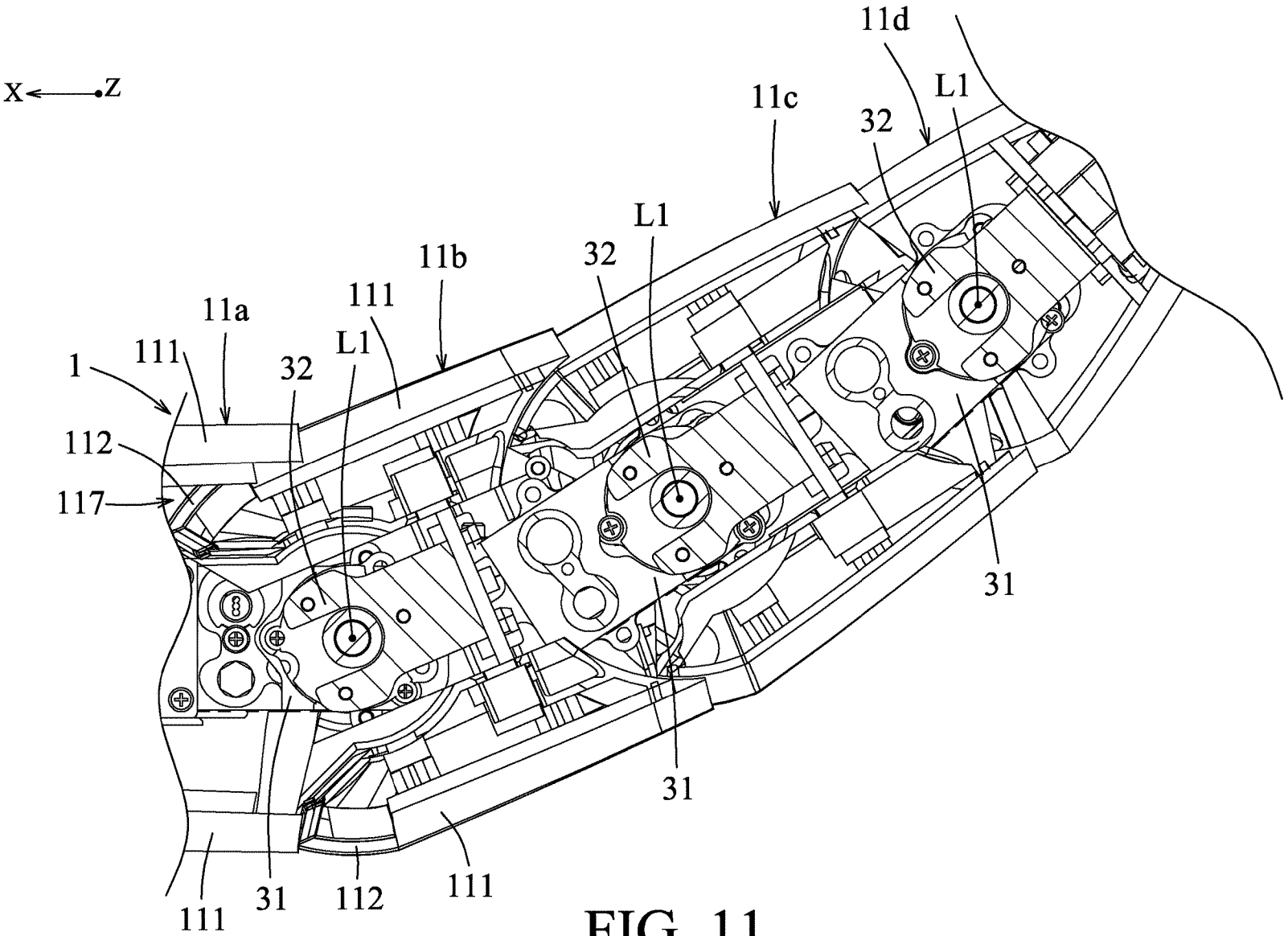
FIG. 11 is a fragmentary enlarged view of FIG. 10.
Figure 12:
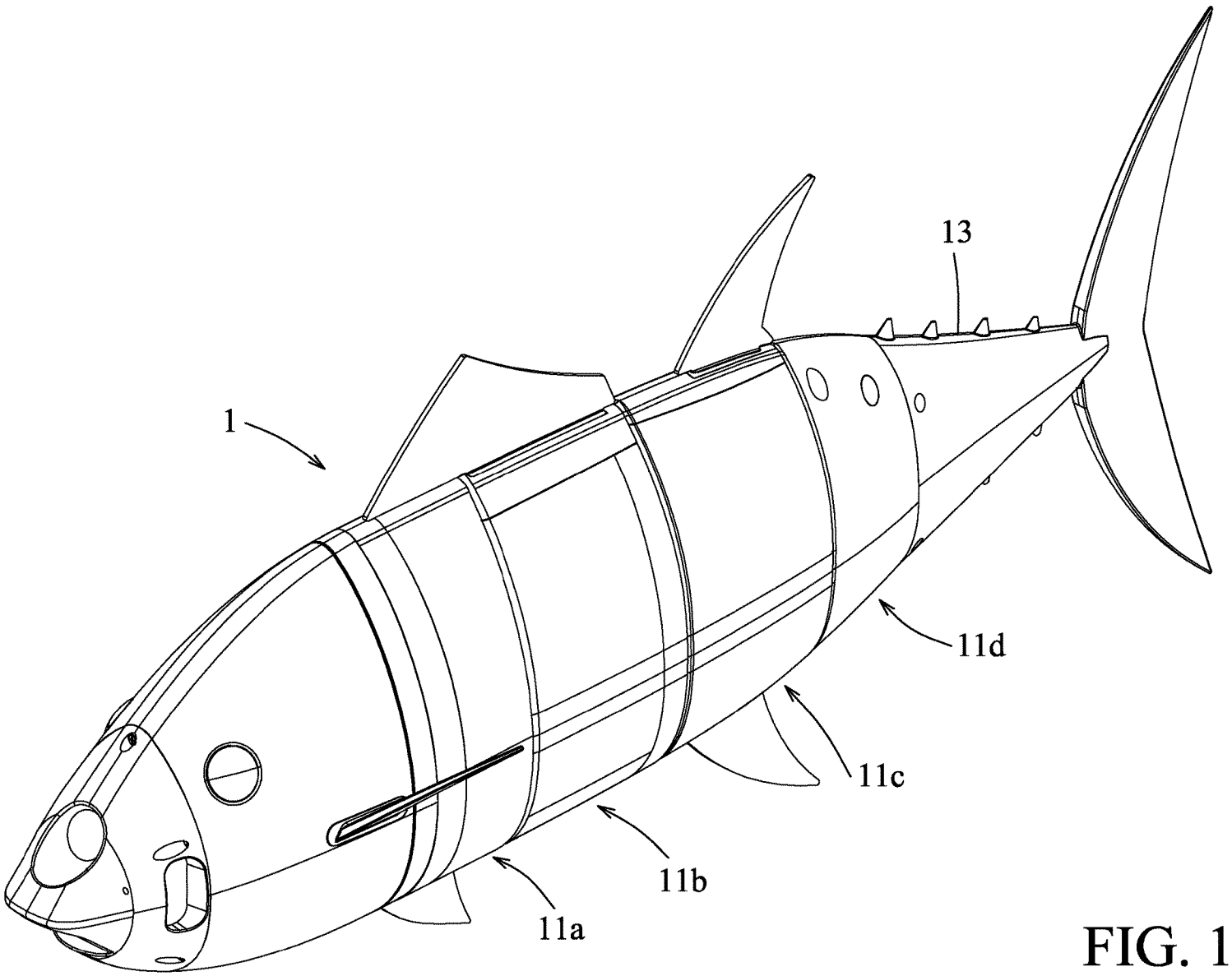
FIG. 12 is a perspective view of the embodiment similar to FIG. 1 but viewed from another angle.

With reference to FIGS. 2 and 3, each shell member has a generally mirror symmetric structure in a left-right direction (Y), and has two shell halves 111 respectively disposed at left and right sides of the rotating mechanisms 3 in the left-right direction (Y) and matingly engaged with each other to define a receiving slot 117 therebetween for receiving a portion of the corresponding rotating mechanism 3. The rear one of two adjacent shell members, i.e., one of the first and second middle shell members (11*b*, 11*c*) and the rearmost shell member (11*d*), has two arcuate flanges 112 which extend respectively and forwardly from front edges of the shell halves 111 and which bend toward each other. The arcuate flanges 112 of the rear shell member (11*b*, 11*c*, 11*d*) are retractably inserted into the receiving slot 117 of the front one of the two adjacent shell members (i.e., one of the foremost shell member (11*a*) and the first and second middle shell members (11*b*, 11*c*)) so as to conceal a gap between the adjoined shell halves 111 of the two adjacent shell members (11*a*, 11*b*, 11*c*, 11*d*). Also, as shown in FIG. 11, when the fish-shaped shell unit 1 imitates a rightward body caudal fin (BCF) movement (a rightward flapping motion) to make rotation of the two adjacent ones of the shell members relative to each other, the right shell half 111 of each rear shell member (11*b*, 11*c*, 11*d*) and the arcuate flange 112 are extended into the receiving slot 117 of the corresponding front shell member (11*a*, 11*b*, 11*c*) while the left shell half 111 of each rear shell member (11*b*, 11*c*, 11*d*) is remote from the shell half 111 of the corresponding front shell member (11*a*, 11*b*, 11*c*) to generate a gap therebetween so as to allow the arcuate flange 112 to be retreated from the receiving slot 117 of the corresponding front shell member (11*a*, 11*b*, 11*c*) and conceal the gap between the two adjacent shell halves 111 at the left side. Thus, during (BCF) locomotion of the biomimetic fish device, the rear one of the shell members (11*a*, 11*b*, 11*c*, 11*d*) is partly extended into the front one of the shell members (11*a*, 11*b*, 11*c*, 11*d*) such that the shell unit 1 can be kept a uniform and seamless appearance without occurrence of stepwise differences and spatial discontinuity.

With reference to FIGS. 2 and 3, each of the first and second middle shell members (11*b*, 11*c*) has two inner partition walls 113 which are disposed in the receiving slot 117 of the corresponding shell halves 111 and respectively connected with the corresponding shell halves 111. The inner partition walls 113 cooperate with the corresponding shell halves 111 and the arcuate flanges 112 to divide the receiving slot 117 into a primary slot portion 118 for receiving a portion of the corresponding rotating mechanism 3, a left air chamber 119 and a right air chamber 119 at left and right sides of the primary slot portion 118, respectively. The left and right air chambers 119 of each of the first and second middle shell members (11*b*, 11*c*) are symmetrical to each other in the left-right direction (Y) so as to preserve the balance of the biomimetic fish device in the left-right direction (Y). Specifically, each of the inner partition walls 113, the shell halves 111 and the arcuate flanges 112 is in the form of an arcuate plate, and each inner partition wall 113 has a convex surface (113*a*) which faces a concave surface (111*a*) of the corresponding shell half 111 and the arcuate flange 112 so as to define the air chamber 119. The left and right air chambers 119 are insulated from the underwater environment for receiving air therein. Additionally, through adjustment of the number and dimensions of the air chambers 119, the specific gravity of the biomimetic fish device can be adjusted to be the same as or approximate to that of water so as to facilitate controlling the movement of the biomimetic fish device.

Each inner partition wall 113 is removably connected with the corresponding shell half 111. Specifically, each inner partition wall 113 has through holes 121 which extend therethrough in the left-right direction (Y). Each shell half 111 has screw holes 120 which are formed in an inner side thereof adjacent to the corresponding inner partition wall 113 and which are respectively aligned with the through holes 121 in the corresponding inner partition wall 113. A plurality of screws 114 having a plurality of watertight washers 115 sleeved thereon, extend through the through holes 121 and are threadedly engaged with the screw holes 120 to removably fasten the inner partition wall 113 to the corresponding shell half 111 and to facilitate forming the air chamber 119. The watertight washers 115 can prevent entrance of water through the clearance between the screws 114 and the through holes 121.

Each of the first and second middle shell members (11*b*, 11*c*) further has two watertight rings 116 which are respectively disposed on peripheries of the inner partition walls 113 and which respectively face the corresponding shell halves 111 to seal clearances between the inner partition walls 113 and the corresponding ones of the shell halves 111 and the arcuate flanges 112.

The fish tail shell 13 is hollow, and defines a tail air chamber 131 therein insulated from the underwater environment for receiving air therein to facilitate adjustment of the specific gravity of the biomimetic fish device same as or approximate to that of water and controlling the movement of the biomimetic fish device.

Figure 4:
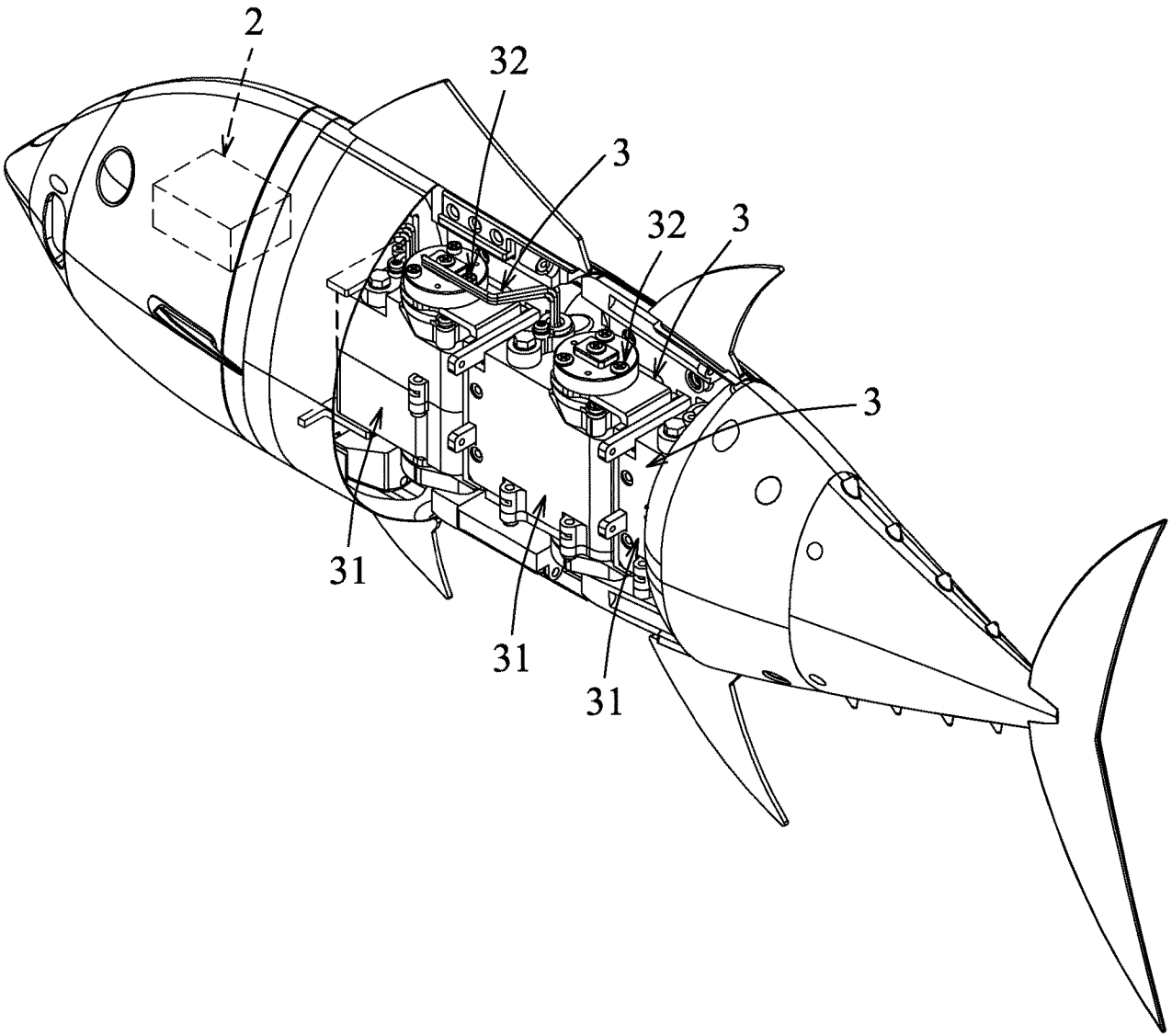
FIG. 4 is a perspective view of the embodiment, with two shell members being removed for the sake of clarity.
Figure 5:
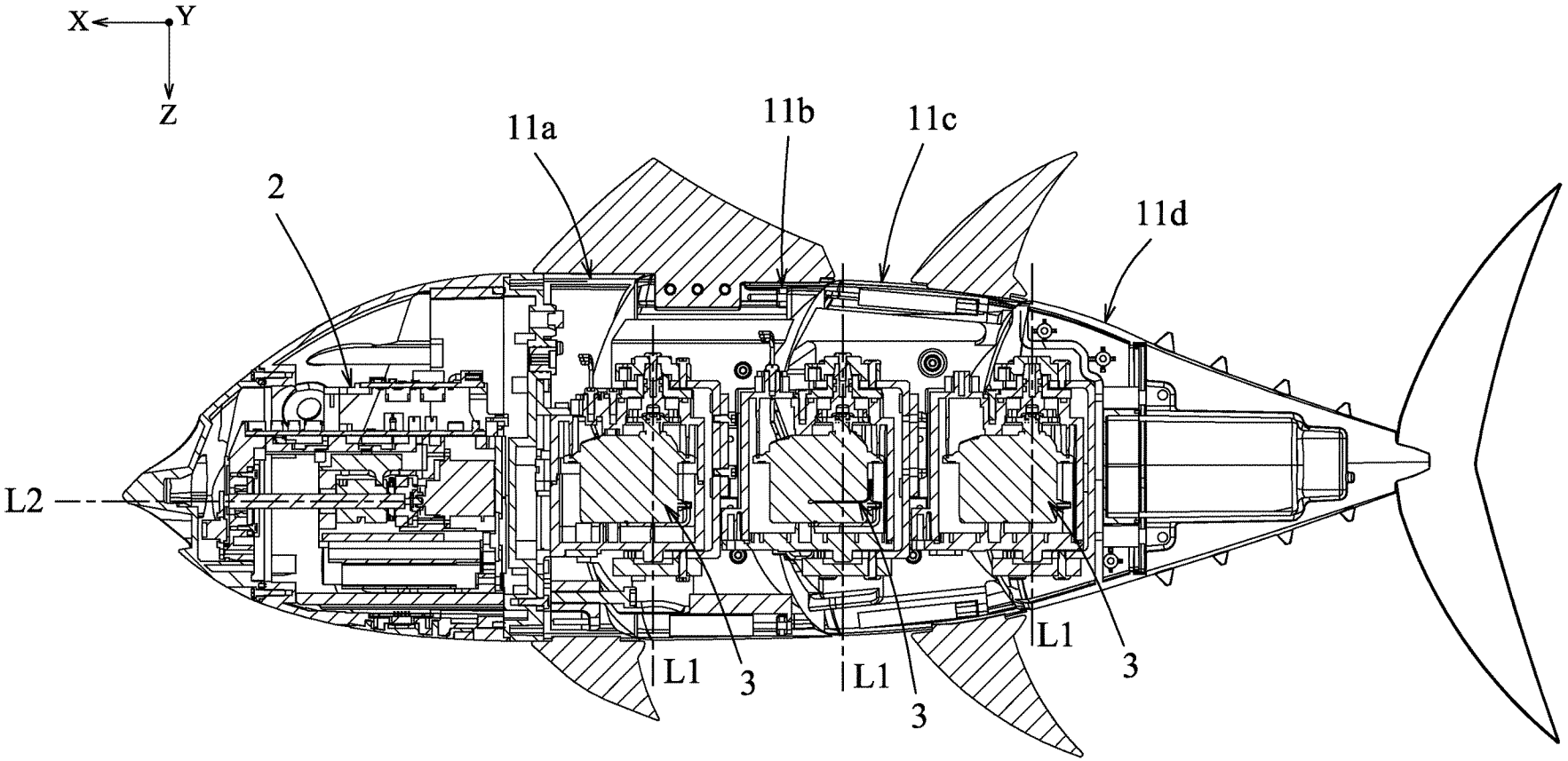
FIG. 5 is a sectional view taken along line V-V of FIG. 1.
Figure 6:
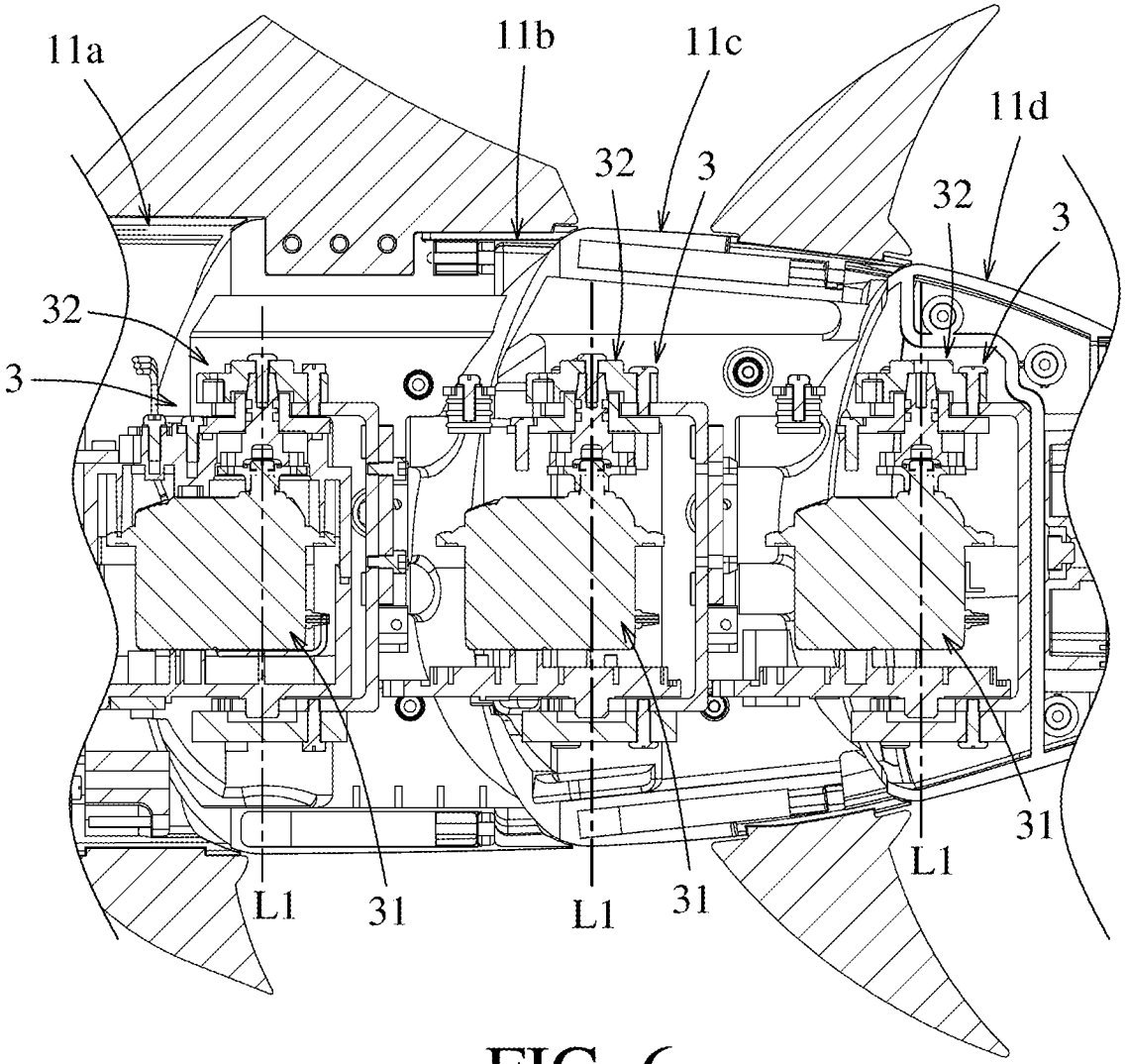
FIG. 6 is a fragmentary enlarged view of FIG. 5.

With reference to FIGS. 4 and 5, the control module 2 is disposed within the front section of the foremost shell member (11*a*). The control module 2 may be in the form of a circuit board which is electronically connected with the rotating mechanisms 3, the gravity transferring mechanism 4 and the sensor module 5 to receive a sensor signal from the sensor module 5 and to transmit control signals to the rotating mechanisms 3 and the gravity transferring mechanism 4.

With reference to FIGS. 5 to 8, each rotating mechanism 3 is disposed within two adjacent ones of the shell members (11*a*, 11*b*, 11*c*, 11*d*). Each rotating mechanism 3 includes a first motor module 31 which is mounted within a front one of the two adjacent shell members (11*a*, 11*b*, 11*c*), and a first rotating member 32 which is mounted to a rear one of the two adjacent shell members (11*b*, 11*c*, 11*d*). The first motor module 31 has a motor electronically connected with the control module 2, a support seat for supporting the motor, and electric lines for connecting the control module 2. The first rotating member 32 has a coupler coupled with the motor, and a frame connected with the corresponding shell member. The first rotating member 32 is pivotably connected with the first motor module 31 about a first axis (L1) in an up-down direction (Z). In this embodiment, the number of the rotating mechanisms 3 is one less than that of the shell members.

Figure 7:
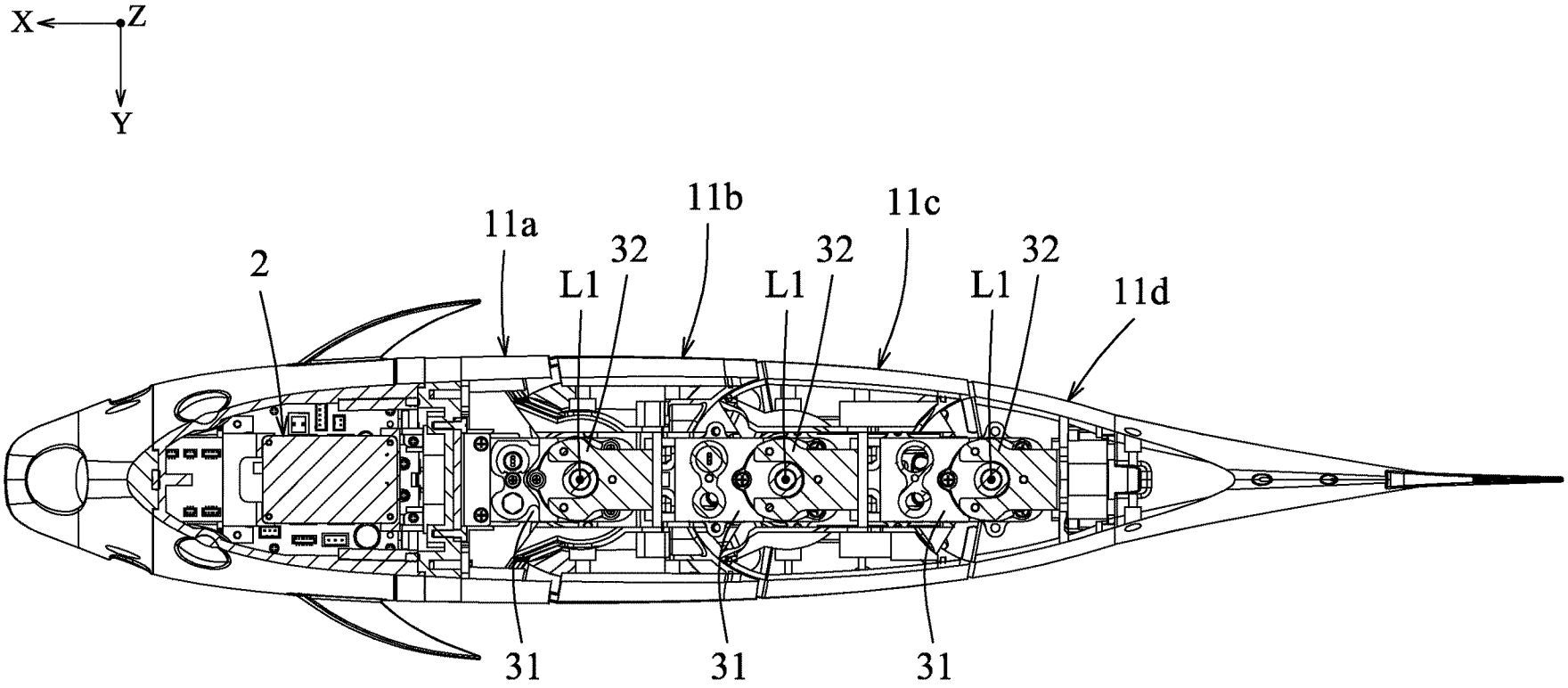
FIG. 7 is a sectional view taken along line VII-VII of FIG. 1.
Figure 8:
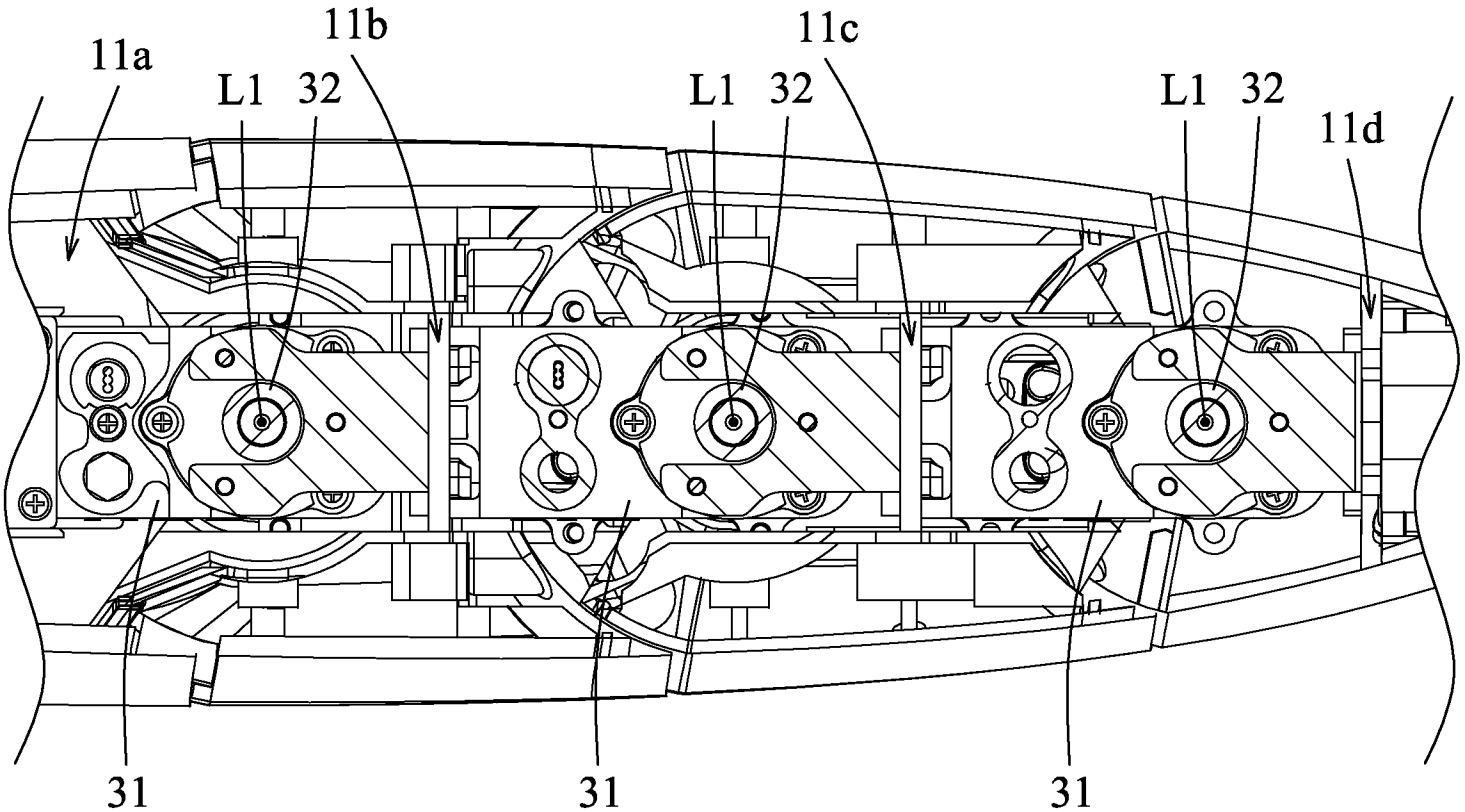
FIG. 8 is a fragmentary enlarged view of FIG. 7.
Figure 9:
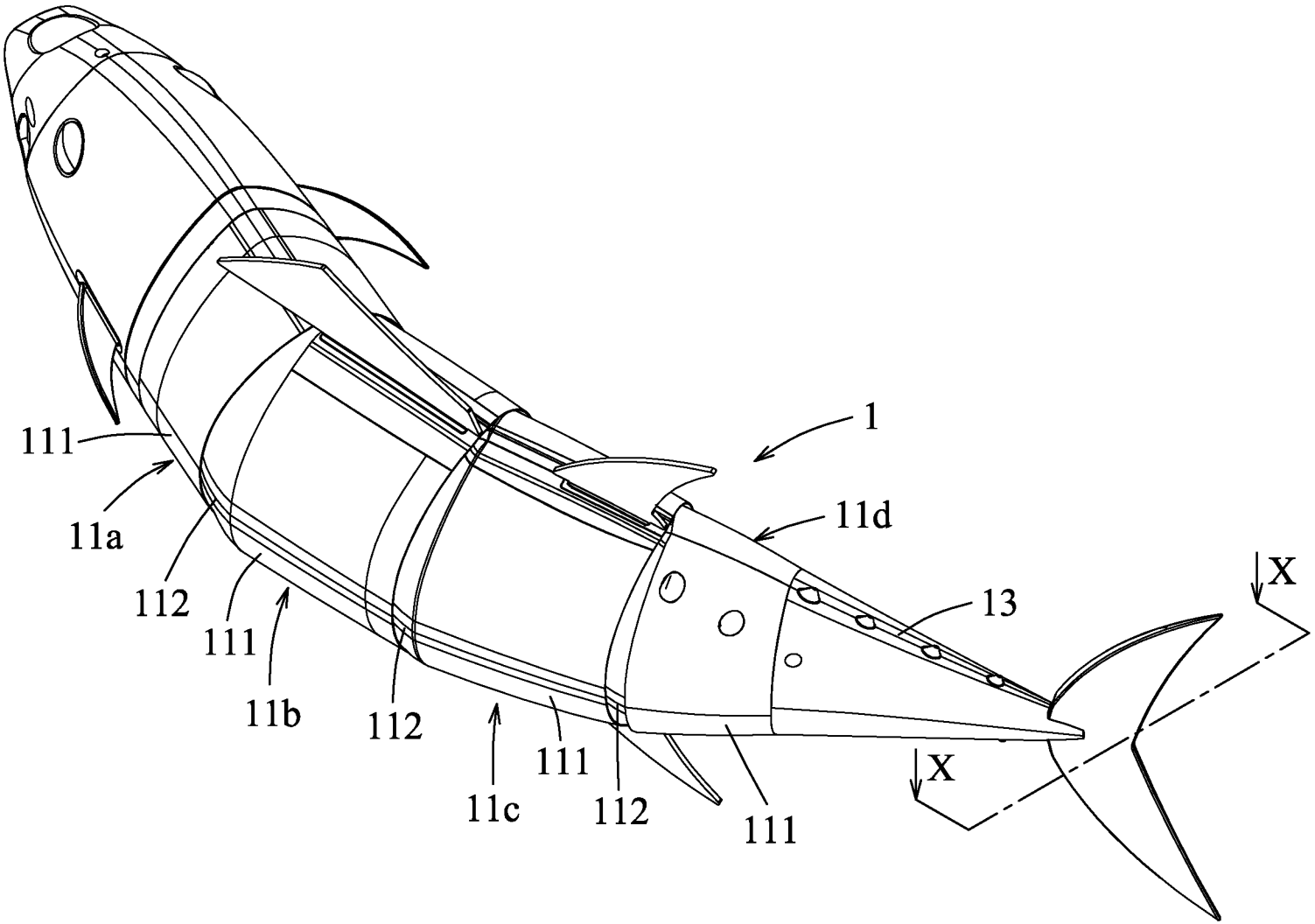
FIG. 9 is a perspective view of the embodiment in a bending state.
Figure 10:
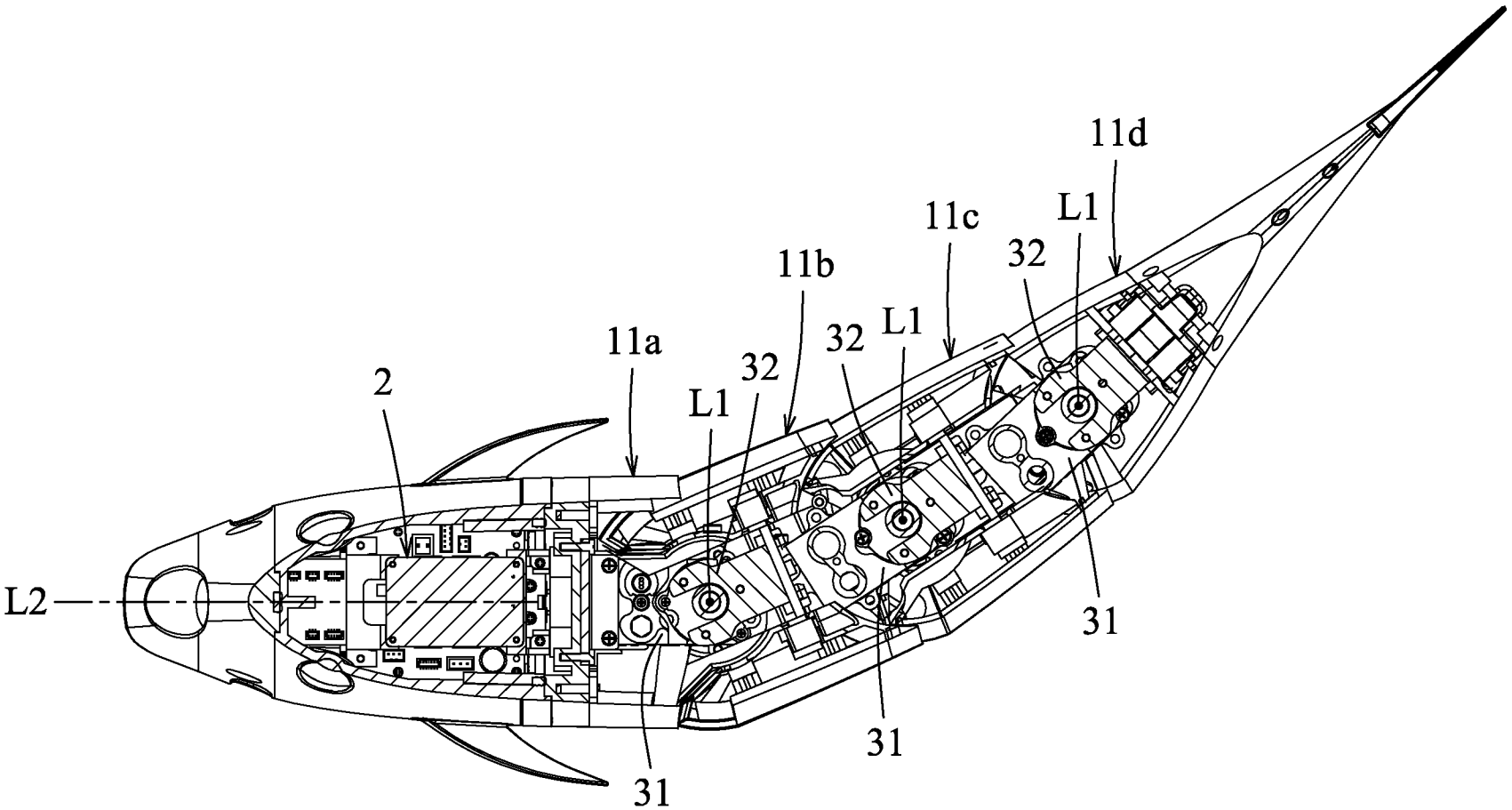
FIG. 10 is a sectional view taken along line X-X of FIG. 9.

With reference to FIGS. 7 to 11, the first motor modules 31 are controlled and operated individually to rotate the corresponding first rotating members 32 about the first axis (L1) by a predetermined angle so as to drive rotation of the rear shell member (11*b*, 11*c*, 11*d*) relative to the front shell member (11*a*, 11*b*, 11*c*). Specifically, the first rotating member 32 is controlled and operated by the corresponding first motor module 31 to rotate clockwise and counterclockwise about the first axis (L1) to bring the rear shell member (11*b*, 11*c*, 11*d*) into reciprocating left and right turnings relative to the front shell member (11*a*, 11*b*, 11*c*). Thus, the biomimetic fish device is shiftable between an initial state and a bending state. It is noted that the rear section of the biomimetic fish device is bendable leftwardly and rightwardly relative to the front section of the biomimetic fish device so as to sway the biomimetic fish device in a left-right direction (Y) during a forward movement in the underwater environment. FIGS. 9 to 11 illustrate the rightward BCF movement (the rightward flapping motion) of the biomimetic fish device. As shown in FIG. 7, in the initial state, the first axes (L1) of the rotating mechanisms 3 are aligned in the front-rear direction (X) such that the shell unit 1 extends straightly along the front-rear direction (X). As shown in FIG. 10, in the bending state, the first axes (L1) are misaligned from each other in the front-rear direction (X). That is, the first axis (L1) of the rear one of two adjacent shell members is more remote from a center line (L2) of the foremost shell member (11*a*) than that of the front one of the shell members causing the shell unit 1 to be slightly curved.

With reference to FIGS. 12 to 16, the gravity transferring mechanism 4 which is disposed within the foremost shell member (11*a*) and under the control module 2. The gravity transferring mechanism 4 includes a second motor module 41 which is mounted within the foremost shell member (11*a*), a second rotating member 42 which is pivotably connected with the second motor module about a second axis (L2) in the front-rear direction (X) (i.e. the center line of the foremost shell member (11*a*)), and a weight member 43 which is movable relative to the second motor module 41 in the front-rear direction (X). The second motor module 41 is electronically connected with the control module 2 to be controlled and operated thereby. Specifically, the second motor module 41 has a motor housing 411, a motor 412 disposed within the motor housing 411, and two guide rods 414 extending in the front-rear direction (X) and respectively disposed at left and right sides of the motor housing 411. The motor housing 411 has an engaging slot 413 formed in a front side thereof and extending in the front-rear direction (X). The second rotating member 42 is coupled with an output shaft of the motor 412 by a coupler, and has a cylindrical cam 421 rotated about the second axis (L2). The cam 421 has a spiral groove 422 formed in an outer peripheral surface thereof and extending spirally around the second axis (L2). In this embodiment, the motor 412 is disposed within the motor housing 411 to render the gravity transferring mechanism 4 more compact. The motor 412 may be disposed outwardly of the motor housing 411 or on the inner wall of the foremost shell member (11*a*). Moreover, the spiral groove 422 extends and surrounds the outer peripheral surface of the cylindrical cam 421, and has a first end 423 (see FIGS. 15 and 16) at a front side of the cam 421, and a second end 424 (see FIGS. 15 and 16) at a rear side of the cam 421.

Figure 17:
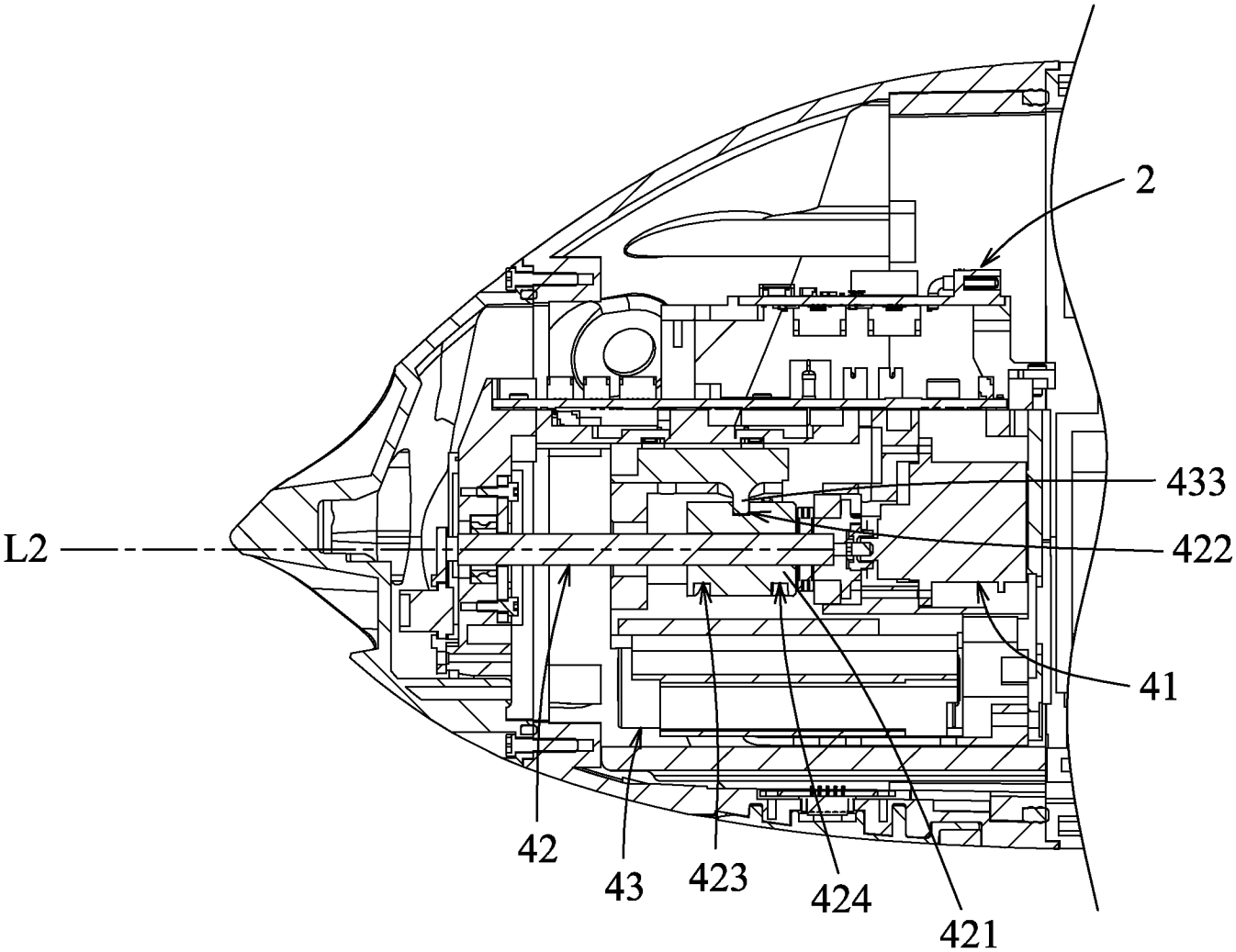
FIG. 17 is a fragmentary enlarged view of FIG. 5, illustrating a gravity transferring mechanism of the embodiment.
Figure 18:
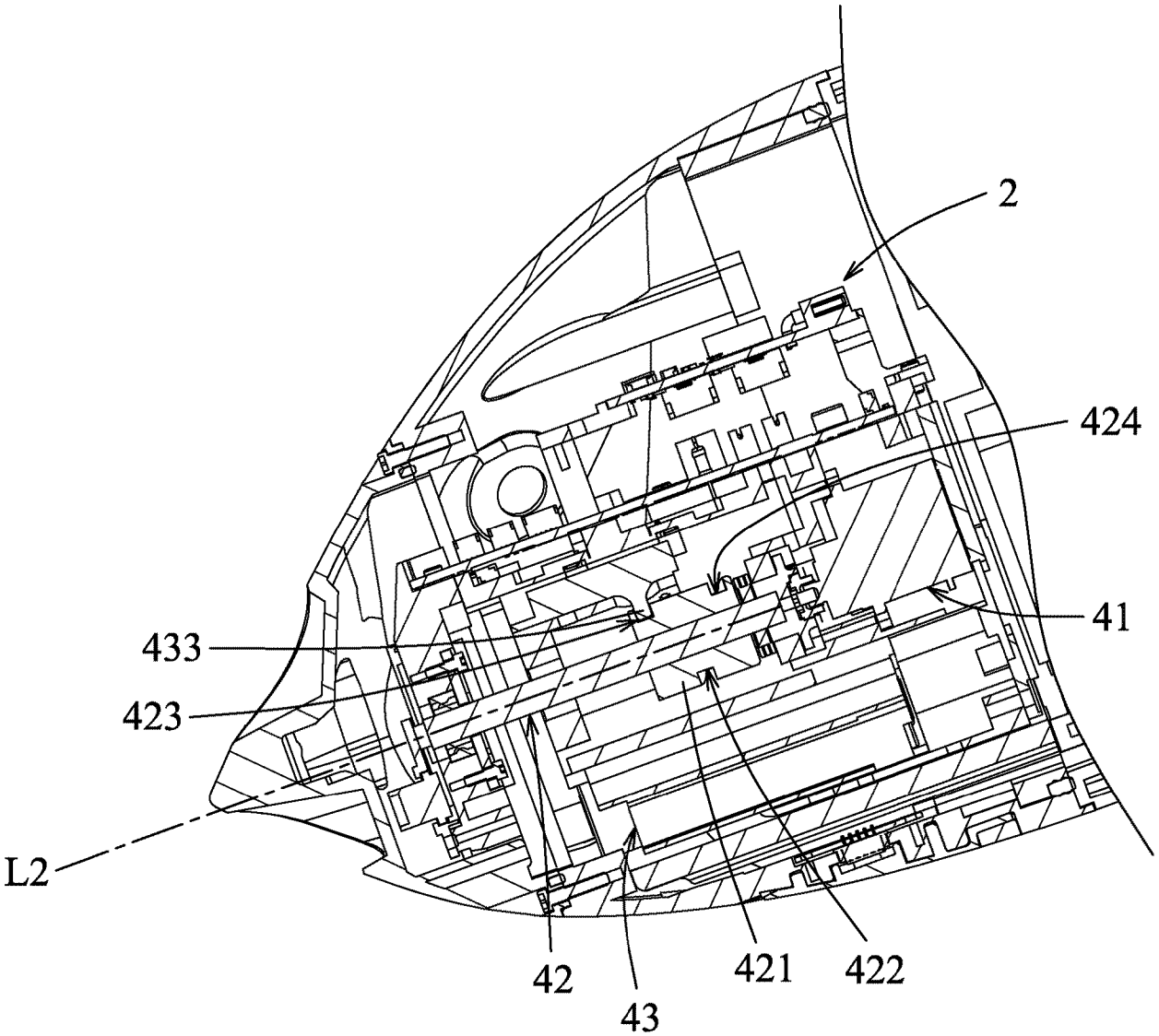
FIGS. 18 and 19 are fragmentary enlarged views illustrating when the gravity transferring mechanism is shifted.
Figure 19:
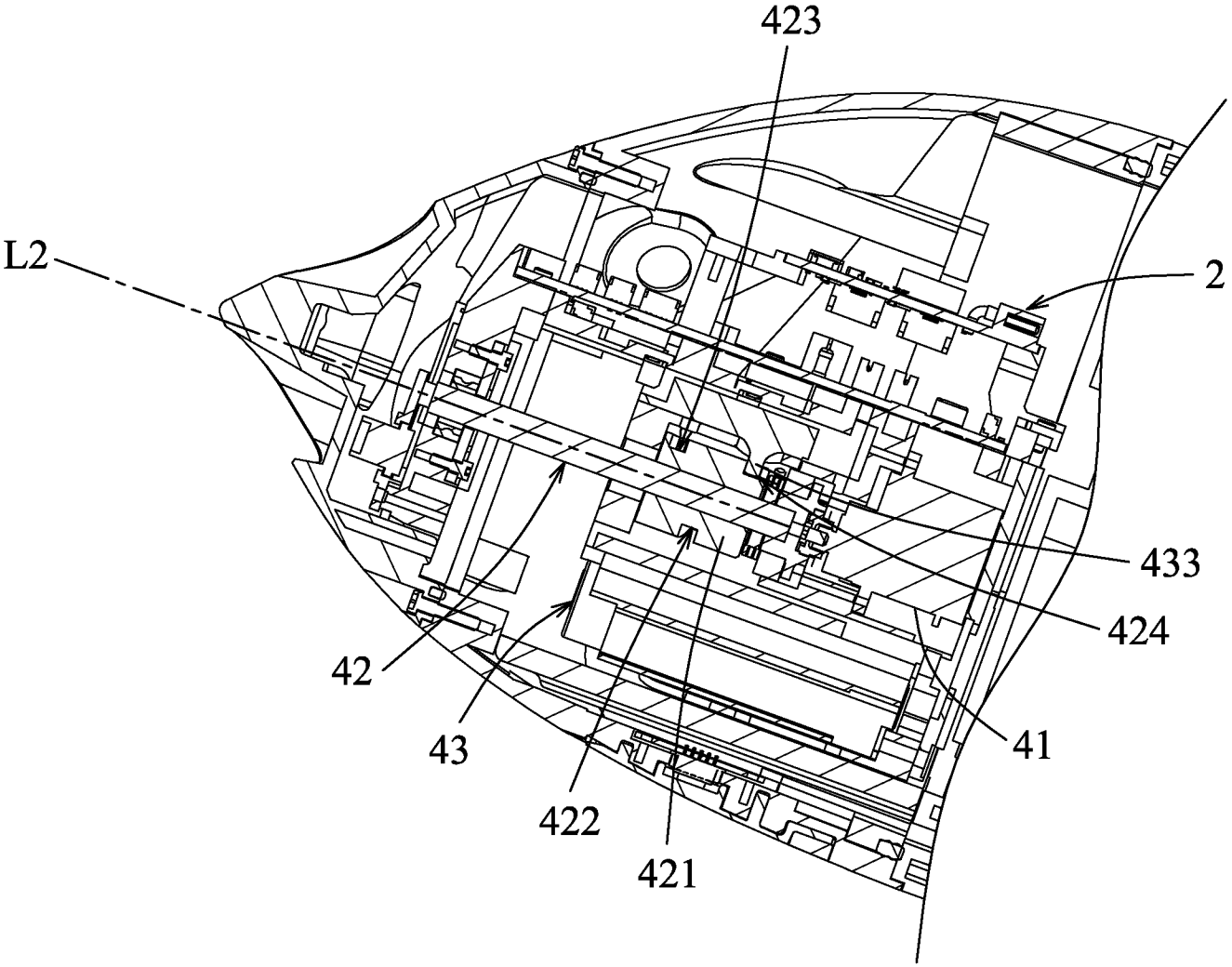

With reference to FIGS. 17 to 19, the weight member 43 has a follower 431 and a battery piece 432 which is movably engaged with the engaging slot 413 in the front-rear direction (X). The guide rods 414 are movably inserted into the battery piece 432 to support the battery piece 432 and permit movement of the battery piece 432 therealong. In some embodiment, the guide rods 414 may be dispensed with. With the engaging slot 413, the battery piece 432 is prevented from movement in the up-down direction (Z) and in the left-right direction (Y). Specifically, the battery piece 432 may be an assembly of a battery box and a plurality of batteries, and is electrically connected with the first motor modules 31 and the second motor module 41 to provide electricity for the first motor modules 31 and the second motor module 41. The follower 431 is disposed on a top portion of the battery piece 432, and has a guided block 433 which extends downwardly through the battery box and which is slidably engaged in the spiral groove 422. When the second motor module 41 is controlled and operated to rotate the cylindrical cam 421 of the second rotating member 42 about the second axis (L2), the guided block 433 is moved along the spiral groove 422 so as to move the weight member 43 in the front-rear direction (X) relative to the second motor module 41 for transferring center of gravity of the biomimetic fish device in the front-rear direction (X). With the battery piece 432 serving as a gravity center of the head of the biomimetic fish device, an additional weight member is not required to avoid increasing the weight of the biomimetic fish device. Moreover, with the engagement of the battery piece 432 with the engaging slot 413, the dimension of the gravity transferring mechanism 4 is reduced to facilitate miniaturization of the biomimetic fish device.

Figure 13:
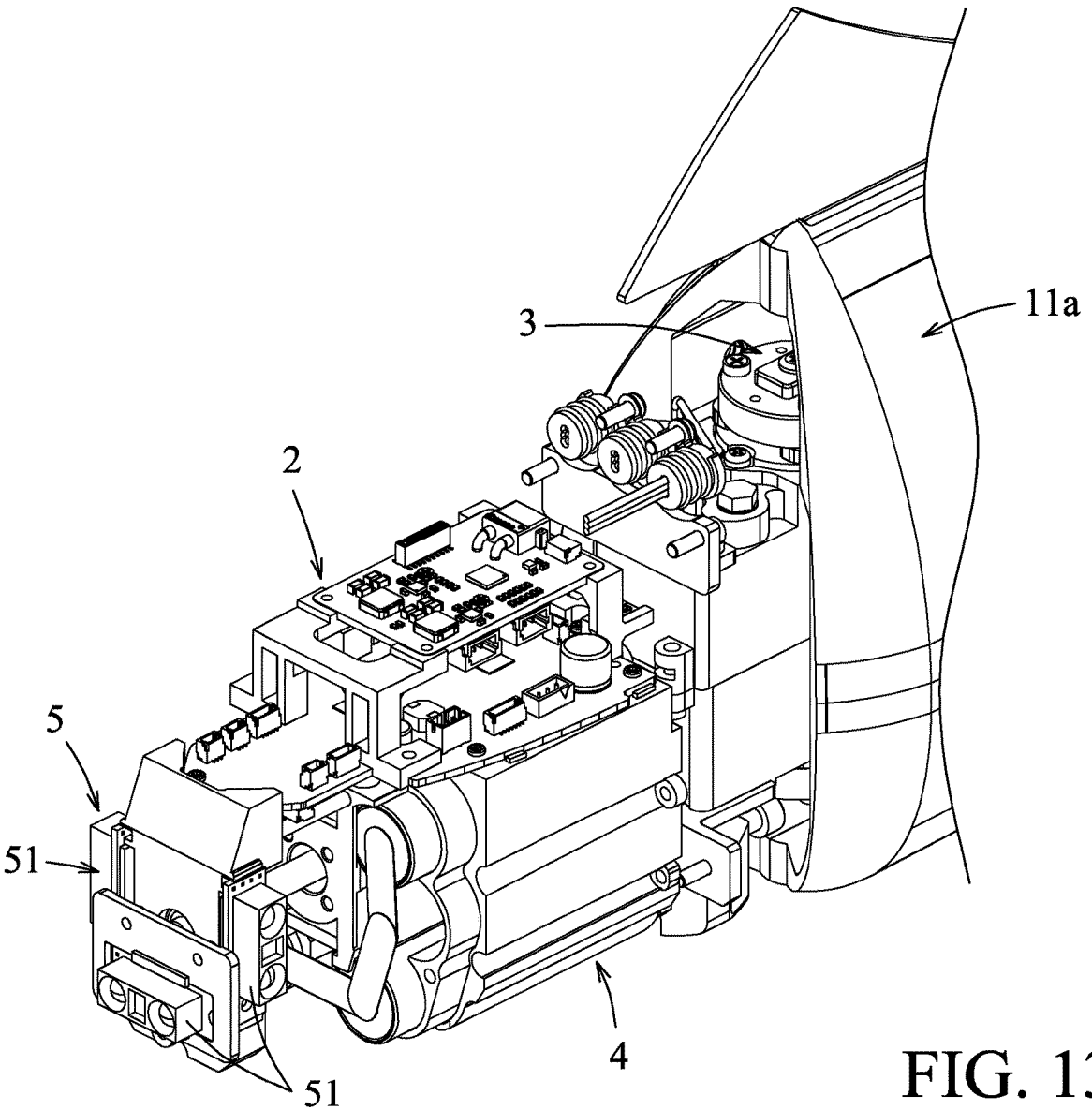
FIG. 13 is a fragmentary perspective view illustrating a portion of the embodiment.
Figure 14:
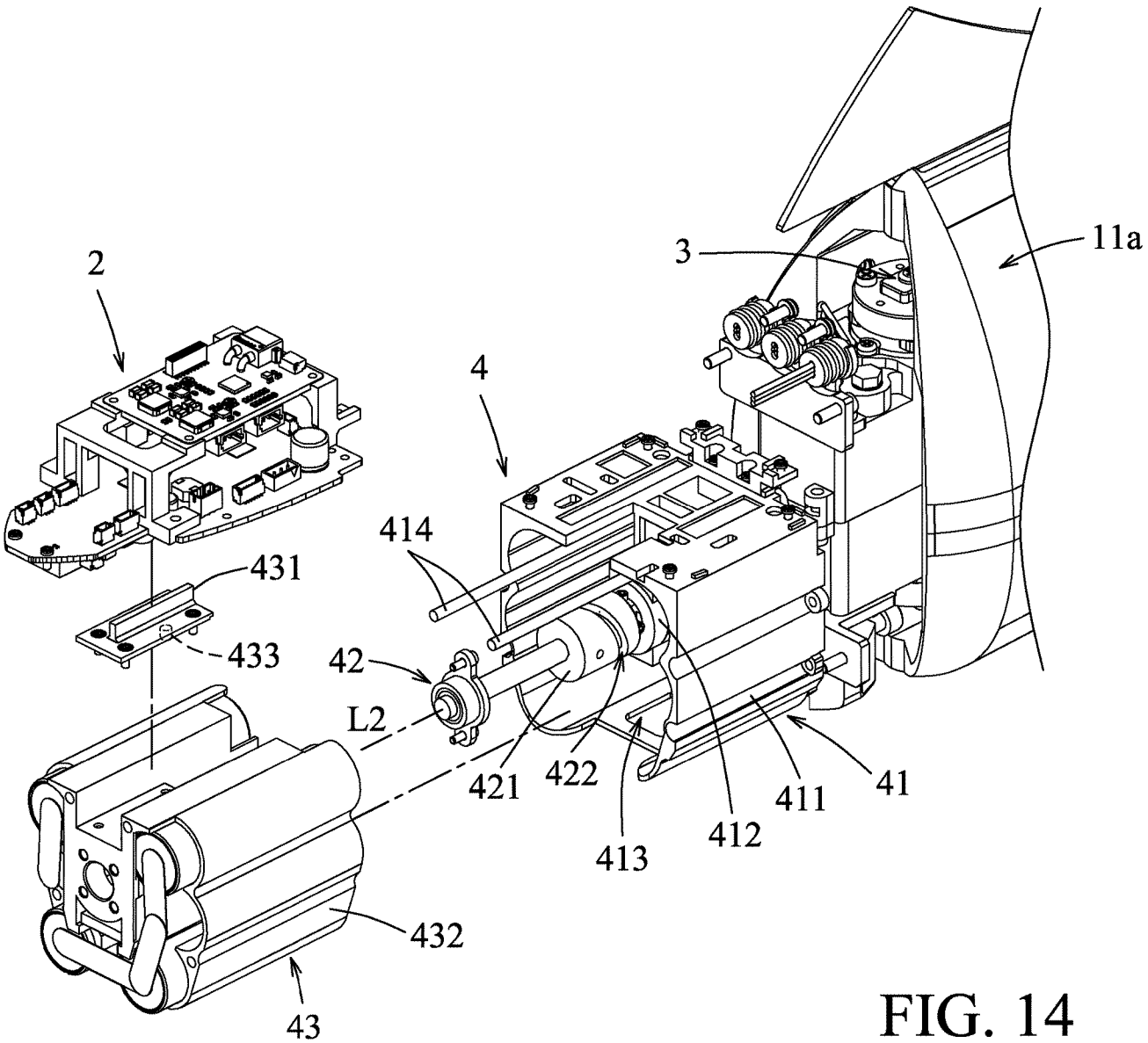
FIG. 14 is an exploded perspective view of FIG. 13.
Figure 15:
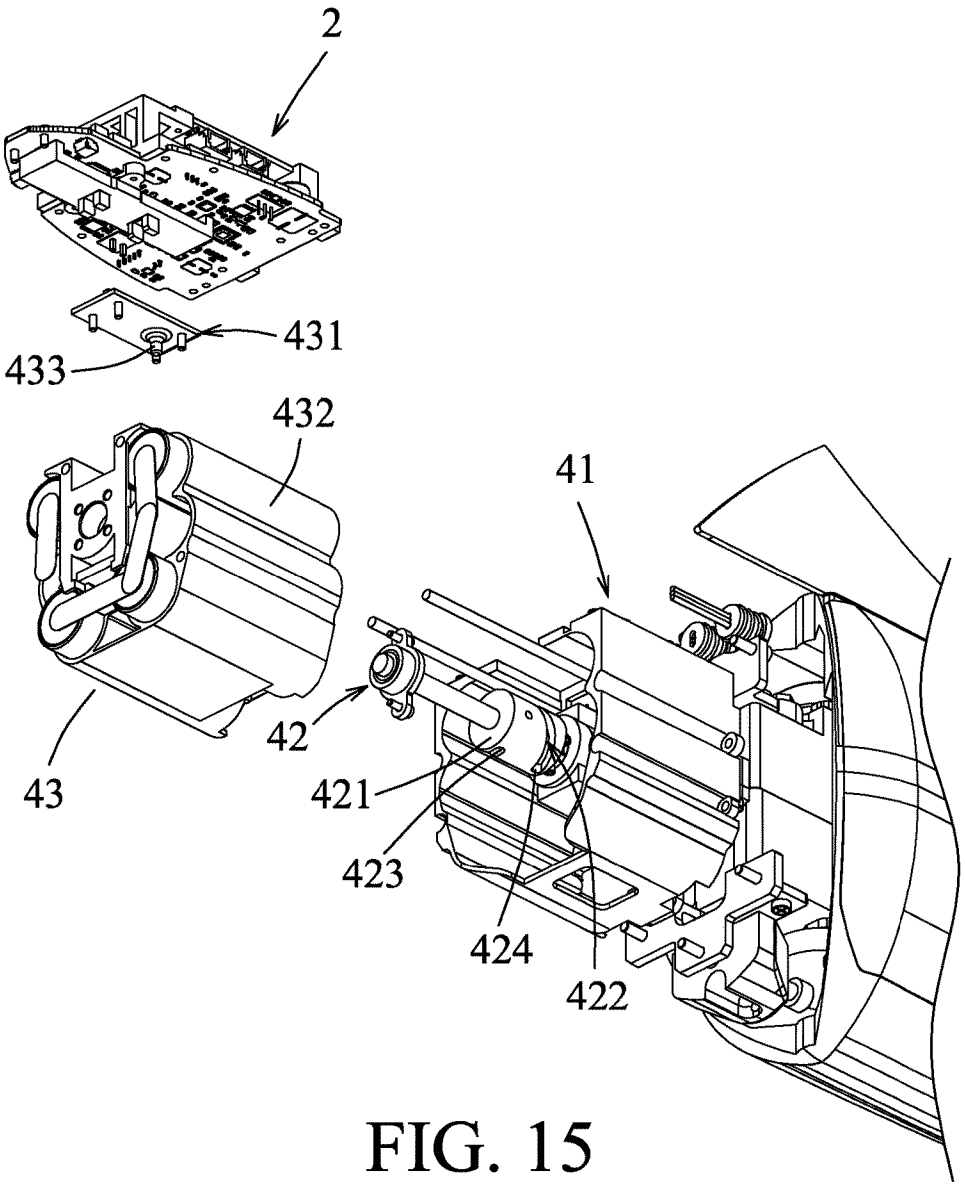
FIGS. 15 and 16 are exploded perspective views similar to FIG. 14 but viewed from another angle.
Figure 16:
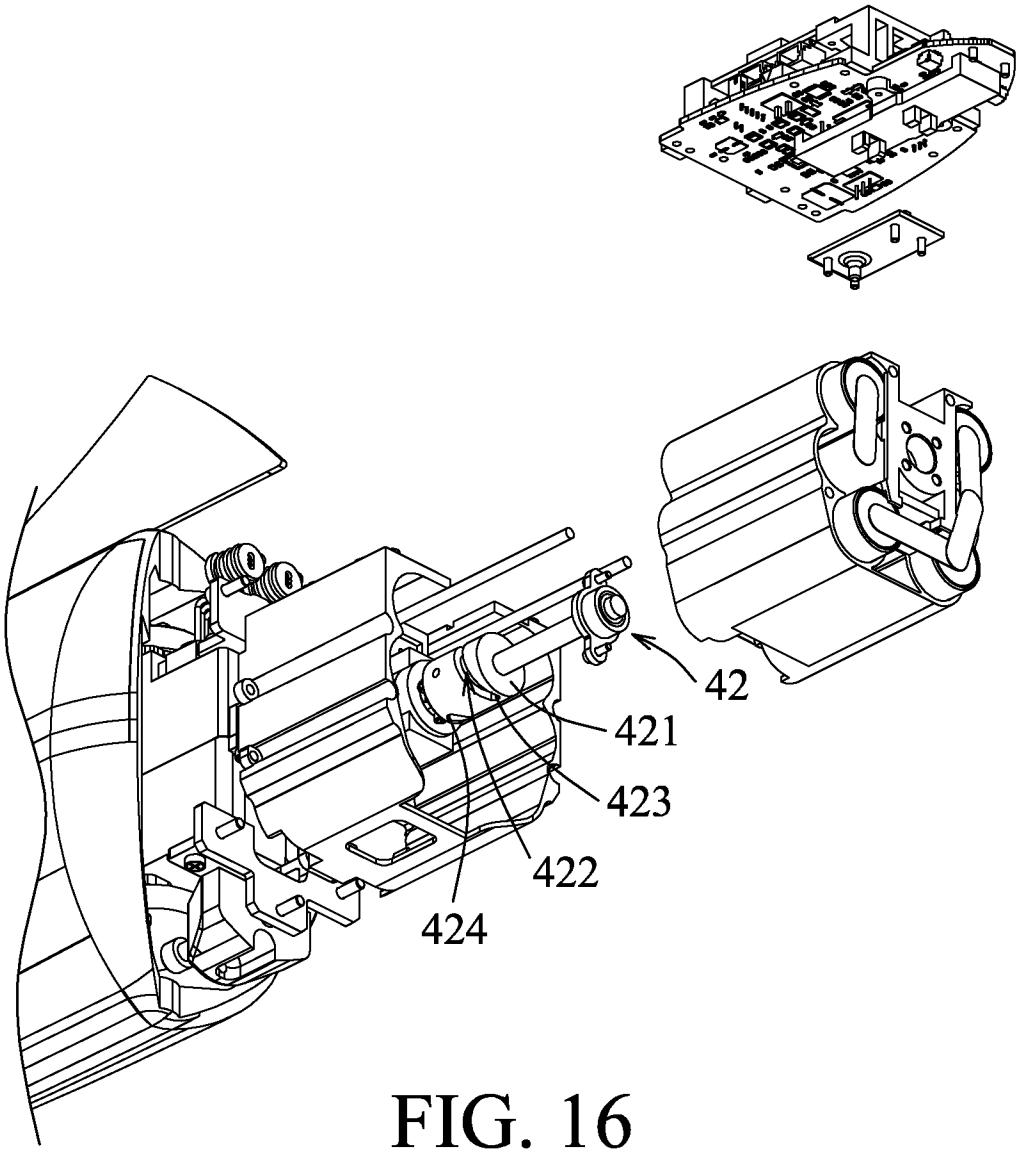

With reference to FIG. 13, the sensor module 5 is electronically connected with the control module 2, and is disposed within the foremost shell member (11*a*) forwardly of the gravity transferring mechanism 4. Specifically, the sensor module 5 includes three sensor elements 51, such as infrared sensors, for sensing an object in the underwater environment. The sensor elements 51 are located at left, right and front sides of the foremost shell member (11*a*), respectively, and adjacent to the fish mouth of the foremost shell member (11*a*), and are electronically connected with the control module 2. When anyone of the sensor elements 51 detects the object, a signal is generated and transmitted to the control module 2 such that the control module 2 controls and operates at least a corresponding one of the first motor modules 31 and the second motor module 41 so as to change a forward movement direction of the biomimetic fish device. In other embodiments, the number of the sensor elements 51 may be one, two or more than three.

In the following, the operation of the biomimetic fish device is described. With reference to FIGS. 7, 8, 10 and 11, when the first rotating members 32 are respectively controlled and operated by the corresponding first motor modules 31 to rotate clockwise and counterclockwise about the first axis (L1), the rear shell member (11*b*, 11*c*, 11*d*) of two adjacent shell members is brought into reciprocating left and right turnings relative to the corresponding front shell member (11*a*, 11*b*, 11*c*). Thus, the biomimetic fish device sways in a left-right direction (Y) during a forward movement in the underwater environment and imitate fish (BCF) locomotion. Further, with the variable range of clockwise and counterclockwise rotations of the first rotating members 32 controlled and operated by the corresponding first motor modules 31, the direction of the forward movement of the biomimetic fish device can be changed as required.

With reference to FIGS. 17 to 19, when the guided block 433 is in the middle section of the spiral groove 422 as shown in FIG. 17, the weight member 43 is located to keep the biomimetic fish device in a horizontal forward movement. When the cylindrical cam 421 is rotated to move the guided block 433 to the first end 423 of the spiral groove 422 as shown in FIG. 18, the weight member 43 is moved forwardly and is partly removed from the engaging slot 413 such that the gravity center of the biomimetic fish device is transferred to a forward site to facilitate downward pitching of the head of the biomimetic fish device for imitating a fish descending motion. When the cylindrical cam 421 is rotated in an opposite direction to move the guided block 433 to the second end 424 of the spiral groove 422 as shown in FIG. 19, the weight member 43 is moved rearwardly and is engaged in the engaging slot 413 such that the gravity center of the biomimetic fish device is transferred to a rearward site to facilitate upward pitching of the head of the biomimetic fish device for imitating a fish ascending motion.

Furthermore, with the sensor elements 51 for sensing an object in the underwater environment, during the forward movement of the biomimetic fish device in the underwater environment, once any one of the sensor elements 51 detects the object at the front, left or right side, a signal is generated by the sensor element 51 and is transmitted to the control module 2, and the control module 2 controls and operates at least a corresponding one of the first motor modules 31 and the second motor module 41 to change a forward movement direction of the biomimetic fish device, such as performing a leftward turn, a right turn, an ascending or a descending movement, so as to avoid the object (obstacles).

As illustrated, with the rotating mechanisms 3 operated to bring respectively the corresponding rear one of the shell members into reciprocating left and right turnings relative to the corresponding front one of the shell members, the fish-shaped shell unit 1 can be bent with a plurality of smaller bending sections so as to imitate the fish (BCF) locomotion during swimming in the underwater environment. Moreover, with the gravity transferring mechanism 4 disposed to transfer the gravity center of the biomimetic fish device in the front-rear direction (X), and with the rotating mechanisms 3 to rotate the shell members so as to sway the fish-shaped shell unit 1, the biomimetic fish device can perform ascending and descending motions. Furthermore, the control module 2 controls and operates at least a corresponding one of the first motor modules 31 and the second motor module 41 when the sensor elements 51 detect an object, to change a forward movement direction of the biomimetic fish device so as to avoid the object. Therefore, the biomimetic fish device can perform a better simulation of live fish.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A biomimetic fish device movable forwardly in an underwater environment, comprising:

a fish-shaped shell unit including a plurality of shell members which are arranged adjacent to each other in a front-rear direction;

a plurality of rotating mechanisms, each disposed within two adjacent ones of said shell members, each of said rotating mechanisms including a first motor module which is mounted within a front one of said two adjacent shell members, and a first rotating member which is mounted to a rear one of said two adjacent shell members and which is pivotably connected with said first motor module about a first axis in an up-down direction, said first motor modules being controlled and operated individually to rotate said corresponding first rotating members about the first axis by a predetermined angle so as to drive rotation of said rear shell member relative to said front shell member, said first rotating member being controlled and operated by said first motor module to rotate clockwise and counterclockwise about the first axis to bring said rear shell member into reciprocating left and right turnings relative to said front shell member so as to sway said biomimetic fish device in a left-right direction during a forward movement in the underwater environment; and a gravity transferring mechanism which is disposed within a foremost one of said shell members, said gravity transferring mechanism including a second motor module which is mounted within said foremost shell member, a second rotating member which is pivotably connected with said second motor module about a second axis in the front-rear direction, and a weight member which is movable relative to said second motor module in the front-rear direction, said second rotating member having a cylindrical cam which has a spiral groove formed in an outer peripheral surface thereof and extending spirally around the second axis, said weight member having a guided block which is slidably engaged in said spiral groove, said second motor module being controlled and operated to rotate said cylindrical cam of said second rotating member about the second axis, which results in movement of said guided block along said spiral groove so as to move said weight member in the front-rear direction relative to said second motor module for transferring center of gravity of said biomimetic fish device.

2. The biomimetic fish device of claim 1, further comprising a control module and a sensor module, said control module being disposed within said foremost shell member, and being electronically connected with each of said first motor modules and said second motor module such that each of said first motor modules and said second motor module is controlled individually by said control module, said sensor module being electronically connected with said control module and being disposed within said foremost shell member, said sensor module including at least one sensor element for sensing an object in the underwater environment such that, when said sensor element detects the object, a signal is generated and transmitted to said control module and said control module controls and operates at least a corresponding one of said first motor modules and said second motor module so as to change a forward movement direction of said biomimetic fish device.

3. The biomimetic fish device of claim 2, wherein said sensor module includes three of said sensor elements, each electronically connected with said control module and disposed respectively at a left side, a right side and a front side of said foremost shell member such that, when any one of said sensor elements detects the object, a signal is generated by said sensor element and is transmitted to said control module.

4. A biomimetic fish device movable forwardly in an underwater environment, comprising:

a fish-shaped shell unit including a plurality of shell members which are arranged adjacent to each other in a front-rear direction; and a plurality of rotating mechanisms, each disposed within two adjacent ones of said shell members, each of said rotating mechanisms including a first motor module which is mounted within a front one of said two adjacent shell members, and a first rotating member which is mounted to a rear one of said two adjacent shell members and which is pivotably connected with said first motor module about a first axis in an up-down direction, said first motor modules being controlled and operated individually to rotate said corresponding first rotating members about the first axis by a predetermined angle so as to drive rotation of said rear shell member relative to said front shell member, wherein each of said shell members has two shell halves respectively disposed at left and right sides of said rotating mechanisms in a left-right direction and matingly engaged with each other to define a receiving slot therebetween for receiving a portion of a corresponding one of said rotating mechanisms, said rear one of said two adjacent shell members having two arcuate flanges which extend respectively and forwardly from front edges of said shell halves and which bend toward each other, said arcuate flanges of said rear shell member being retractably inserted into said receiving slot of said front one of said two adjacent shell members so as to conceal a gap between said shell halves of said two adjacent shell members.

5. The biomimetic fish device of claim 4, wherein at least one of said shell members has two inner partition walls, each disposed in said receiving slot and connected with a corresponding one of said shell halves, said inner partition walls cooperating with said corresponding shell halves and said arcuate flanges to divide said receiving slot into a primary slot portion, a left air chamber and a right air chamber at left and right sides of said primary slot portion, respectively, said left and right air chambers being insulated from the underwater environment.

6. The biomimetic fish device of claim 5, wherein each of said inner partition walls has at least one through hole which extends therethrough in the left-right direction, each of said shell halves having a screw hole which is formed in an inner side thereof adjacent to said corresponding inner partition wall and which is aligned with said through hole in said corresponding inner partition wall, at least one of said shell members having at least one screw and at least one watertight washer sleeved on said screw, said screw extending through said through hole and being threadedly engaged with said screw hole to removably fasten said inner partition wall to said corresponding shell half.

7. The biomimetic fish device of claim 6, wherein at least one of said shell members has two watertight rings which are respectively disposed on peripheries of said inner partition walls and which respectively face said corresponding shell halves to seal clearances between said inner partition walls and the corresponding ones of said shell halves and said arcuate flanges.

8. A biomimetic fish device movable forwardly in an underwater environment, comprising:

a fish-shaped shell unit including a plurality of shell members which are arranged adjacent to each other in a front-rear direction; and a plurality of rotating mechanisms, each disposed within two adjacent ones of said shell members, each of said rotating mechanisms including a first motor module which is mounted within a front one of said two adjacent shell members, and a first rotating member which is mounted to a rear one of said two adjacent shell members and which is pivotably connected with said first motor module about a first axis in an up-down direction, said first motor modules being controlled and operated individually to rotate said corresponding first rotating members about the first axis by a predetermined angle so as to drive rotation of said rear shell member relative to said front shell member, wherein said fish-shaped shell unit further includes a fish tail shell which is disposed on a rearmost one of said shell members and which defines a tail air chamber therein.

* * * * *